United States Patent [19]

van der Sluys et al.

[11] Patent Number: 4,526,009

[45] Date of Patent: Jul. 2, 1985

[54] METHOD OF OPERATING A BIMODAL HEAT PUMP, AS WELL AS BIMODAL HEAT PUMP FOR USING SAID METHOD

[75] Inventors: Willem L. N. van der Sluys; Mathias L. Hermans, both of Eindhoven, Netherlands

[73] Assignee: U.S. Philips Corporation, New York, N.Y.

[21] Appl. No.: 610,356

[22] Filed: May 15, 1984

Related U.S. Application Data

[63] Continuation of Ser. No. 456,235, Jan. 7, 1983, abandoned.

[30] Foreign Application Priority Data

Oct. 28, 1982 [NL] Netherlands ..... 8204161

[51] Int. Cl.[3] ..... F25B 15/00

[52] U.S. Cl. ..... 62/101; 62/324.2; 62/476

[58] Field of Search ..... 62/101, 324.2, 476

[56] References Cited

U.S. PATENT DOCUMENTS

| | | | |
|---|---|---|---|
| 2,212,869 | 8/1940 | Tornquist | 62/324.2 X |
| 2,749,095 | 6/1956 | Anderson, Jr. et al. | 62/324.2 X |
| 3,528,491 | 9/1970 | Bell, Jr. | 62/101 X |
| 4,178,989 | 12/1979 | Takeshita et al. | 62/476 X |
| 4,363,219 | 12/1982 | Koseki et al. | 62/101 |
| 4,411,140 | 10/1983 | Katsumata et al. | 62/324.2 |

*Primary Examiner*—Lloyd L. King

*Attorney, Agent, or Firm*—Rolf E. Schneider

[57] ABSTRACT

There is provided a method of operating a bimodal heat pump which in a first mode operates as an absorption heat pump and in a second mode operates as an evaporation-condensation device at a comparatively low ambient temperature. When switching from the first mode to the second mode, the evaporator and the absorber are uncoupled from the generator and the condenser. The generator and the condenser are operated in the second mode as an evaporation-condensation device, an extra quantity of working medium being present. The passage from the condenser to the evaporator is positioned at a level that provides the extra quantity of the working medium when starting the second mode.

2 Claims, 2 Drawing Figures

METHOD OF OPERATING A BIMODAL HEAT PUMP, AS WELL AS BIMODAL HEAT PUMP FOR USING SAID METHOD

This is a continuation of application Ser. No. 456,235, filed Jan. 7, 1983, now abandoned.

This invention relates to a method of operating a bimodal heat pump which in a first mode operates as an absorption pump and in a second mode operates as an evaporation-condensation device, in which first mode at least a part of a dissolved working medium is separated in a generator from a solvent by heating and is then transported in the gaseous state to a condenser in which the working medium is liquefied by giving off thermal energy to a heat-transporting medium, after which the liquefied working medium is expanded and evaporated in an evaporator by taking up thermal energy from the environment and is further transported to an absorber in which the working medium is bonded to the solvent while giving off thermal energy to a heat-transporting medium, while another part of the still bonded working medium in the generator is pumped to the absorber together with the relevant part of the solvent and a part of the working medium and the solvent is returned from the absorber to the generator, in which second mode the connections between the evaporator and condenser and the absorber and the generator, respectively, are closed and a connection for the working medium between the condenser and the generator is opened.

The invention also relates to a heat pump for using the method described.

In a known method of this kind (European Pat. No. 0 001 858), during the switching from the absorption heat pump to the evaporation-condensation device, first the connection between the condenser and the evaporator is closed after which the liquid working medium in the evaporator is caused to flow to the absorber. The working medium bonded to the solvent is then pumped from the absorber to the generator and separated there from the solvent. The gaseous working medium from the generator is liquefied in the condensor and stored there for the time being. The separation of the working medium is continued until solvent from the absorber is also evaporated in the generator and a pressure of a previously determined value occurs in the generator. By means of a pressure sensor a signal is obtained, by the use of which the high-pressure connection between the absorber and the generator is temporarily closed. The liquid solvent from the generator now flows into the absorber. By means of a level sensor in the generator it is determined when the solvent from the generator has flowed to the absorber. The low-pressure connection between the generator and the absorber is then closed, while a new connection between the condenser and the generator is opened. The working medium collected in the condenser is now used in the evaporation-condensation device formed by the generator and condenser. This evaporation-condensation device thus operates with pure working medium, in the present case ammonia ($NH_3$).

As can be established by means of a graph in which the logarithm of the pressure is plotted against the temperature, a considerable rise in temperature occurs already during boiling-out the working medium to percentages smaller than usual (approximately 10% $NH_3$). An even further rise in temperature occurs during the increase in pressure necessary for the signal of the pressure sensor after complete boiling-out of the ammonia. The resulting total rise in temperature is of such a value that the possibility of decomposition is present in several kinds of working medium and solvent. For example, the decomposition temperature of the working medium used in this case, ammonia, is approximately 180° C., while the decomposition temperature of the equally usual solvent glycol is approximately 170° C. Thus the known method restricts the choice of the working medium considerably.

It is the object of the present invention to provide a method with which the disadvantage described is avoided, and to provide a heat pump for using the method according to the invention which considerably automates the switching from the first mode to the second mode, and conversely.

For that purpose the method according to the invention is characterized in that upon switching from the first mode to the second mode an extra quantity of working medium is provided in the cycle formed by the generator and the condenser and the concentration of the working medium in the generator compared with the concentration of the working medium in the first mode is increased, which extra quantity of working medium is stored again in the condenser when switching from the second mode to the first mode.

The heat pump according to the invention is characterized in that the extra quantity of working medium is stored in a part of the condenser which is connected to the generator by means of a closable transport pipe, the outflow level from the condenser being located above the inflow level in the generator, the condenser having an overflow the level of which is equal to the level of a connection between the condenser and the evaporator, the level of the overflow determining the quantity of extra working medium in the condenser.

The invention will now be described in greater detail with reference to the accompanying drawings, in which.

Figure 1:
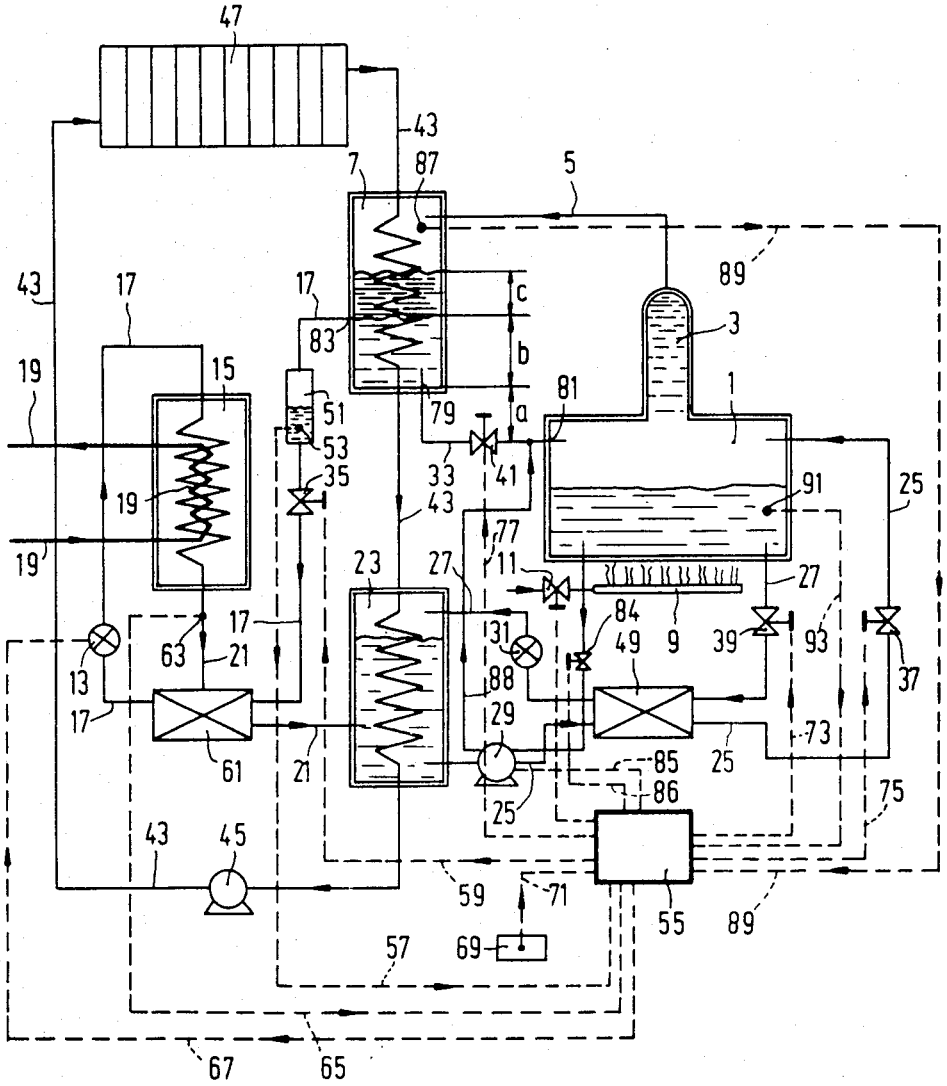
FIG. 1 shows a bimodal heat pump according to the invention.

The bimodal heat pump shown in FIG. 1 comprises a generator 1 having a rectification column 3 which is connected to a condenser 7 by a transport pipe 5. The generator 1 with the rectification column 3 is of any usual type. A gas burner 9 is arranged below the generator 1 and is provided with gas from a gas cock 11. Via a thermostatic expansion valve 13 the condenser 7 is connected to an evaporator 15 by means of a transport pipe 17. Thermal energy from the environment of the heat pump is applied to the evaporator 15. Said thermal energy can be withdrawn, for example, from a liquid heat-transporting medium, for example ground water, which is brought in heat exchanging contact with the evaporator 15 by means of a system of transport pipes 19 shown diagrammatically. The evaporator 15 is connected to an absorber 23 by a transport pipe 21. Both the evaporator 15 and the absorber 23 are of a type which is usual for heat pumps. The absorber 23 is connected by means of a transport pipe 25 to the generator 1 which is also connected to the absorber 23 by means of a further transport pipe 27. A pump 29 is incorporated in the transport pipe 25 while an expansion valve 31 is placed in the transport pipe 27. The condenser 7 is connected to the generator 1 by means of a special transport pipe 33 to be described hereinafter. Valves 35, 37, 39 and 41 are placed in the transport pipes 17, 25, 27 and 33, respectively.

The heat pump is coupled to a system of transport pipes 43 for a heat-transporting medium. In the present case the heat-transporting medium is water. The heat exchanging contact between the water in the system of transport pipes 43 and the heat pump takes place successively in the condenser 7 and the absorber 23. A pump 45 ensures the transport of the water in the system of transport pipes in the direction indicated by arrows. The so-called effective heat is derived by means of a heat exchanger 47 in the system of transport pipes 43. The generator contains a solution of water (solvent) and ammonia (working medium). The percentage of ammonia is 30% at the beginning of boiling-out. The pressure in the generator 1 is 20 atm. The absorber 23 contains a solution of water and ammonia with a comparatively high ammonia content of 30%. For convenience it is assumed that the demand for thermal energy at the heat exchanger 47 remains constant so that the same adjustment of the gas burner 9 will suffice. For the pair of substances water-ammonia it may be assumed that the heat pump can sensibly be operated as an absorption heat pump (first mode) up to an outdoor temperature of approximately −5° C. without too large a pumping capacity being required due to the comparatively small degassing width at said temperature.

Figure 2:
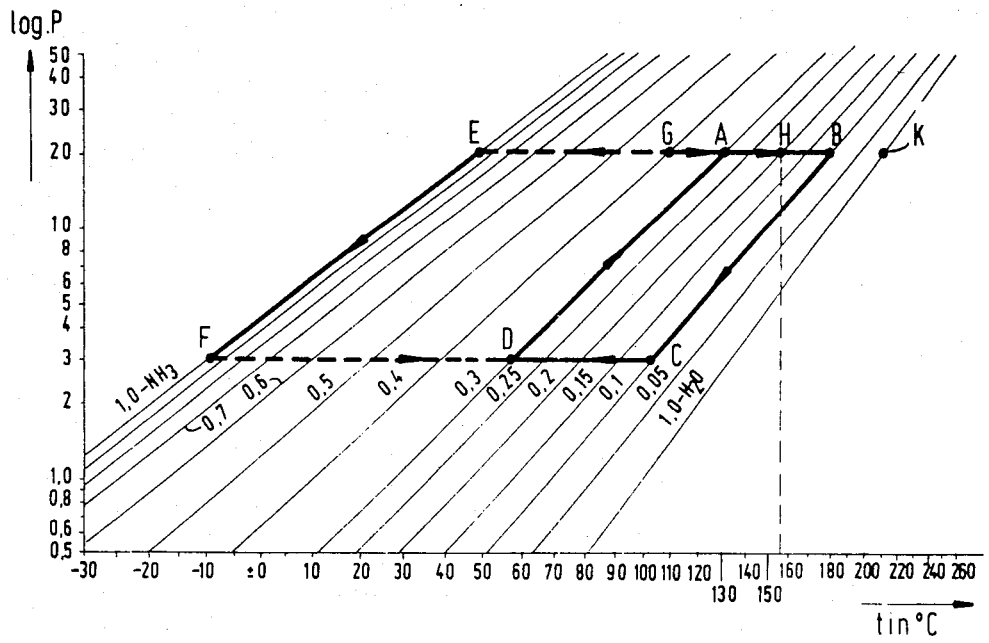
FIG. 2 is a graph in which the logarithm of the pressure is plotted against the temperature at different concentrations of the working medium.

In the graph shown in FIG. 2 the boiling-out of the ammonia from the solution in the generator 1 is started at the point denoted by A. As the boiling-out proceeds, the percentage of ammonia in the solution decreases to 10% while the temperature in the generator has gradually increased to 180° C. The point denoted by B in the graph is then reached. Although it is possible to increase the degassing width by boiling-out more ammonia, boiling-out to approximately 10% ammonia is to be preferred in order not to exceed the decomposition temperature of ammonia (approximately 180° C.). The solution depleted in ammonia in the generator 1 is continuously pumped through the cycle formed by the generator 1, the transport pipe 27, the absorber 23 and the transport pipe 25 by means of the pump 29. In the absorber 23 the solution is enhanced with ammonia from 10% to 30% and then pumped back to the generator 1 where the boiling-out of ammonia from the solution is continued. The beginning of the absorption in the absorber 23 is indicated in the graph by point C, while the end of the absorption is denoted by point D. During the absorption in the range C–D, the heat of absorption is delivered to the water in the system of transport pipes 43. The range B–C represents the expansion of the poor solution by the expansion valve 31. The pressure increase due to the pump 29 is represented by the track A–D. Exchange of heat takes place in a heat exchanger 49 between the hot, depleted solution in transport pipe 27 and the cold, rich solution in transport pipe 25. Accordingly, the efficiency of the heat pump is increased because the cold, rich solution flows into the generator 1 already in a preheated condition. Also the gaseous ammonia boiled-out in the generator 1 is removed from evaporated water in the rectification column 3 and is then conveyed through the transport pipe 5 to the condenser 7 in which the gaseous ammonia is liquefied by giving off thermal energy to the water in the system of transport pipes 43. The liquid ammonia is conveyed to the evaporator 15 from the condenser 7 via the transport pipe 17. The liquid ammonia passes through the thermostatic expansion valve 13 which brings the liquid ammonia near or to the evaporation pressure. A liquid seal 51 is incorporated in the transport pipe 17 so as to prevent ammonia vapour from flowing directly from the condenser 7 into the evaporator 15 as a result of which the condensation of the ammonia vapour would take place in the evaporator 15. For that purpose the liquid seal 51 includes a level sensor 53 which at a given level of the liquid ammonia gives off a signal to a process control device 55 via a signal line 57. The process control device 55 then locks, via a signal line 59, the valve 35 which is opened again only when the level sensor 53 indicates that sufficient liquid ammonia is again present in the liquid seal 51. The evaporator 15 provides gaseous ammonia while taking up heat of evaporation from the environment, in the present case ground water which by means of the system of transport pipes 19 is brought in heat transmitting contact with the liquid ammonia in the evaporator 15. The gaseous ammonia is transported from the evaporator 15 via the transport pipe 21 to the absorber 23 and is dissolved there in the ammonia-water solution. In the graph shown in FIG. 2 the point E represents the condensation in the condenser 7, the point F represents the evaporation in the evaporator 15 and the track E–F represents the expansion by the expansion valve 13. The liquid ammonia in the transport pipe 17 and the gaseous ammonia in the transport pipe 21 are brought in heat exchanging contact with each other in a heat exchanger 61. The liquid ammonia is sub-cooled and the evaporation in the evaporator is intensified. The sub-cooling enthalpy which is withdrawn from the liquid ammonia is also added to the gaseous ammonia as a result of which an improvement of the efficiency of the heat pump is achieved. A temperature sensor 63 is incorporated in the transport pipe 21 and measures the superheating temperature and converts it into an electrical signal which is applied to the process control device 55 via a signal line 65. The process control device 55 ensures, via the signal line 67, the correct adjustment of the thermostatic expansion valve 13 when the load of the evaporator 15 varies. In this manner the extent of superheating is kept constant for various evaporator loads. This means that always so much ammonia is supplied to the evaporator 15 as can be evaporated.

In case the outdoor temperature drops below a given value (for the pair of substances water-ammonia approximately −5° C.) the degassing width is decreased so considerably that quantities of solution which are not acceptable for practical purpose have to be circulated by pumping. In such circumstances it is known inter alia from European Pat. No. 0 001 858 to operate a heat pump in a second mode as an evaporation-condensation device. In that case the evaporator and the absorber are uncoupled from the system.

The heat pump according to the invention comprises a temperature sensor 69 which, when the outdoor temperature is too low, signals, via a signal line 71, to the process control device 55 that a switching operation should be carried out. The process control device 55 then locks the valves 35, 39 and 37 via signal lines 59, 73 and 75 and then opens the valve 41 in the transport pipe 33 via a signal line 77. The pump 29 is stopped by the process control device 55 via a signal line 85.

The gas burner 9 may continue burning. Because the outflow aperture 79 of the condenser 7 is located at a distance a above the inflow aperture 81 of the generator 1, a quantity of liquid ammonia which corresponds to the distance b+c flows from the condenser 7 to the generator 1. The quantity of ammonia corresponding to the distance b is an extra stored quantity which during the first mode does not take part in the heat pumping process because the outflow aperture 83 is located at a level which is equal to the level at which the transport pipe 17 emanates from the condenser 7. Therefore the outflow aperture 83 operates as an overflow. The quantity of ammonia corresponding to the distance c is the quantity which takes part in the absorption heat pumping process (first mode). As a result of the extra quantity of ammonia from the condenser 7 the concentration of the ammonia in the solution of the generator 1 is increased. In a practical case the concentration of ammonia in the generator 1 may increase, for example, to 40%, which corresponds to point G in the graph of FIG. 2. If, for comparison with the first mode, a degassing width of 20% is started from, this means that the end of the boiling-out of the ammonia in the second mode corresponds to point H in FIG. 2. Now a valve 84 is opened by means of a signal from the process control device 55 via a signal line 86. The valve 84 is incorporated in a transport pipe 88 which is connected to the transport pipe 33. The pump 29 is started again so that the poor solution is pumped out of the generator 1 and is mixed in the transport pipe 33 with the liquid ammonia flowing out of the condenser 7. The direction of pumping in the second mode is opposite to that in the first mode.

Whereas the boiling-out in the first mode according to track A-B takes place between 132° C. and 180° C., boiling-out in the second mode is carried out between 110° C. and 157° C. at the same degassing width of 20%. This means that the generator temperature can be increased if a higher condenser temperature is necessary without the risk of decomposition of the working medium increasing. It also means that working media and solvents having a lower decomposition temperature can be used. To be considered is, for example, in working medium glycol in combination with the solvent ethylamine or the working medium methanol in combination with the solvent lithium bromide, or the working medium difluoromonochloromethane ($CHClF_2$) in combination with the solvent tetraethyleneglycol dimethyl ether. In the second mode the condensation also takes place at point E of FIG. 2. The whole process then occurs at the pressure of 20 atm. It is to be noted that it is not necessary to switch on the pump 29 in the second mode. In that case there is an average ammonia concentration in the the generator 1 if the constructions of generator and the condenser 7 are adapted thereto. The degassing width now is equal to zero. The average concentration of the ammonia in the generator then is, for example, equal to 25%. Boiling-out then takes place at 143° C. There is no boiling-out range but a boiling-out point in the graph of FIG. 2.

It will be obvious that point A in the graph of FIG. 2 need not necessarily be at 30% ammonia. Dependent on the temperature range and the degassing width which is desired, point A may also be at a comparatively high percentage of ammonia, for example at 90%. The degassing width may then be chosen to be comparatively large, so that pump 29 in the first mode needs to pump only a comparatively small quantity of solution.

In the method according to European Pat. No. 0 001 858, point K in the second mode in FIG. 2 would have to be reached (to the right) because the increasing pressure to be established by the pressure sensor in the rectification column takes place only when all ammonia has been boiled-out (Gibbs' phase rule). Since point K is at approximately 210° C., the decomposition temperature of ammonia would be exceeded. Thus, the known method can be used only with the pair of substances water-ammonia when the condenser pressure is reduced. This restricts the field of application of the known method considerably.

If the temperature sensor 69 indicates that the outdoor temperature is again above −5° C., switching to the first mode can be carried out simply. The valve 41 is closed while the valves 35, 39 and 37 are opened again and the pump 29 is started. A fresh quantity of extra ammonia is automatically formed again in the condenser 7 by condensation up to the level of the outflow aperture 83.

In order to protect the condenser 7 from too high a pressure, a pressure sensor 87 is connected, via a signal line 89, to the process control device 55. This extinguishes the gas burner 9 at too high a condenser pressure. Furthermore a level sensor 91 is present in the generator 1 and is connected, via a signal line 93, to the process control device 55. When the level of the solution in the generator 1 becomes too low and the possibility occurs that ammonia gas reaches the transport pipe 27, the process control device 55 closes the valve 39 via the signal line 73.

It is to be noted that the heat pump according to the invention is not restricted to a system in which the thermal energy required for evaporation is derived from ground water in the first mode. In principle, said thermal energy can be derived from any heat source of a suitable temperature, for example, the outer air. The heat in the exhaust gases of the gas burner 9 can also be supplied via a heat exchanger to the water in the system of transport pipes 43. The heat of condensation of the solvent evolved in the rectification column 3 can be applied, for example, by means of a heat exchanger, to the water in the system of transport pipes 43. Instead of a gas burner 9 any other heat source may of course also be used for heating the generator. For example it may be heated electrically.

What is claimed is:

1. A method of operating a bimodal heat pump, said heat pump operating in a first mode as an absorption heat pump and in a second mode as an evaporation-condensation device, which comprises in said first mode heating a generator containing a solution of a working medium in a solvent to separate a part of the dissolved working medium in the gaseous state from the solvent; passing the separated gaseous working medium to a condenser for liquefaction by the giving up of thermal energy to a heat-transport medium, a further quantity of liquid working medium being stored in said condenser; thereafter expanding and evaporating the liquefied working medium in an evaporator by the taking up of thermal energy from the environment; passing the evaporated working medium to an absorber for solution in the solvent while giving up thermal energy to a heat-transport medium; pumping another part of the working medium-solvent solution from the generator to the absorber while pumping working medium-solvent solution from the absorber to the generator; and which comprises in said second mode only passing the separated gaseous working medium from the generator to the condenser and returning the liquefied working medium together with the further quantity of the working medium from the condenser to the generator; and which further comprises, in switching over from the first mode to the second mode, closing the passage from the condenser to the evaporator and the passage from the evaporator to the aborber, discontinuing the pumping of the working medium-solvent solution between the generator and the absorber and between the absorber and the generator, and opening the passage from the condenser to the generator; and which also comprises, in switching back from the second mode to the first mode, opening said closed passages and closing said open passage, the further quantity of the working medium again being stored in the condenser.

2. A heat pump for operation by the method according to claim 1, in which the condenser is positioned at a height greater than that of the generator, and in which the passage from the condenser to the evaporator is located at a level equivalent to the further quantity of liquid working medium stored in the condenser during the first mode.

* * * * *